US008950840B2

(12) United States Patent
Sakakibara

(10) Patent No.: US 8,950,840 B2
(45) Date of Patent: Feb. 10, 2015

(54) INKJET PRINTER

(71) Applicant: Akihiro Sakakibara, Aichi (JP)

(72) Inventor: Akihiro Sakakibara, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/852,164

(22) Filed: Mar. 28, 2013

(65) Prior Publication Data

US 2013/0278655 A1 Oct. 24, 2013

(30) Foreign Application Priority Data

Apr. 20, 2012 (JP) ..... 2012-096946

(51) Int. Cl.
*B41J 29/38* (2006.01)

(52) U.S. Cl.
USPC ..... 347/9; 347/8; 347/5

(58) Field of Classification Search
USPC ..... 347/5, 8, 16, 9, 12
See application file for complete search history.

(56) References Cited

U.S. PATENT DOCUMENTS

| | | | | |
|---|---|---|---|---|
| 6,092,939 | A | 7/2000 | Nishikori et al. | |
| 6,310,637 | B1 | 10/2001 | Shimada et al. | |
| 6,557,961 | B2 * | 5/2003 | Cheng et al. | 347/9 |
| 2004/0126164 | A1 | 7/2004 | Ohyama | |
| 2008/0150978 | A1 | 6/2008 | Sato et al. | |
| 2009/0262157 | A1 | 10/2009 | Sato et al. | |
| 2012/0086747 | A1 | 4/2012 | Terada | |

FOREIGN PATENT DOCUMENTS

| | | | |
|---|---|---|---|
| JP | 2003-054078 | A | 2/2003 |
| JP | 2004-017586 | A | 1/2004 |
| JP | 2004-106978 | A | 4/2004 |
| JP | 3554184 | B2 | 8/2004 |
| JP | 2006-167995 | A | 6/2006 |
| JP | 2006-192814 | A | 7/2006 |
| JP | 2007-025492 | A | 2/2007 |
| JP | 2008-155423 | A | 7/2008 |
| JP | 2008-155424 | A | 7/2008 |
| JP | 2009-023121 | A | 2/2009 |
| JP | 2009-143152 | A | 7/2009 |
| JP | 2009-202430 | A | 9/2009 |
| JP | 2012-076429 | A | 4/2012 |
| JP | 2012-096378 | A | 5/2012 |

* cited by examiner

*Primary Examiner* — Lam S Nguyen
(74) *Attorney, Agent, or Firm* — Scully, Scott, Murphy & Presser, P.C.

(57) ABSTRACT

An inkjet printer is provided that includes a control device configured to determine ink discharge moments to sequentially discharge ink droplets from a specific one of nozzles, in such a manner that a time interval between any two successive ones of the ink discharge moments is longer than a predetermined time period required for an operation to be executed by an inkjet head when forming a single dot, based on gap variation information related to a variation, in a scanning direction, of a gap between an ink discharge surface and a recording sheet held in a wave shape.

11 Claims, 13 Drawing Sheets

INKJET PRINTER

CROSS-REFERENCE TO RELATED APPLICATION

This application claims priority under 35 U.S.C. §119 from Japanese Patent Application No. 2012-096946 filed on Apr. 20, 2012. The entire subject matter of the application is incorporated herein by reference.

BACKGROUND

1. Technical Field

The following description relates to one or more techniques for an inkjet printer configured to perform printing by discharging ink droplets from nozzles onto a recording medium.

2. Related Art

As an example of inkjet printers that perform printing by discharging ink droplets from nozzles onto a recording medium, an inkjet printer has been known that is configured to perform printing by discharging ink droplets onto a recording sheet (a recording medium) from a recording head (an inkjet head) mounted on a carriage reciprocating along a predetermined scanning direction. Further, the known inkjet printer is configured to cause feed rollers and corrugated holding spur wheels to press the recording sheet against a surface of a platen that has thereon convex portions and concave portions alternately formed along the scanning direction, so as to deform and hold the recording sheet in a predetermined wave shape. The predetermined wave shape has mountain portions protruding toward an ink discharge surface of the recording head, and valley portions recessed in a direction opposite to the direction toward the ink discharge surface, the mountain portions and the valley portions alternately arranged along the scanning direction.

SUMMARY

In the known inkjet printer, a gap (distance) between the ink discharge surface of the recording head and the recording sheet varies depending on portions (positions) on the recording sheet held in the wave shape (hereinafter, which may be referred to as a "wave-shaped recording sheet"). Therefore, when the known inkjet printer performs printing by discharging ink droplets from the recording head onto the wave-shaped recording sheet with the same ink discharge timing as when performing printing on a recording sheet not held in such a wave shape, the ink droplets might land in positions deviated from their respective desired positions on the recording sheet. Thus, it might result in a low-quality printed image. Further, at this time, the deviations of the ink landing positions differ from one portion (position) to another on the recording sheet.

In order to land ink droplets in appropriate positions on the wave-shaped recording sheet, for instance, it may be considered as one of possible solutions to adjust ink discharge timing to discharge the ink droplets from the inkjet head in response to the gap between the ink discharge surface and each portion (of the mountain portions and the valley portions) on the recording sheet.

Aspects of the present invention are advantageous to provide one or more improved techniques for allowing an inkjet printer to determine appropriate ink discharge timings (moments) to discharge ink droplets into appropriate positions on a wave-shaped recoding sheet.

According to aspects of the present invention, an inkjet printer is provided that includes an inkjet head configured to discharge ink droplets from nozzles formed in an ink discharge surface thereof, a head moving unit configured to reciprocate the inkjet head relative to a recording sheet along a scanning direction parallel to the ink discharge surface, a wave shape generating mechanism configured to deform and hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction, a gap variation storing unit configured to store gap variation information related to a variation, in the scanning direction, of a gap between the ink discharge surface and the recording sheet held in the wave shape, and a control device configured to determine, based on the gap variation information, ink discharge moments to sequentially discharge ink droplets from a specific one of the nozzles, in such a manner that a time interval between any two successive ones of the ink discharge moments is longer than a predetermined time period for an operation to be executed by the inkjet head when forming a single dot.

BRIEF DESCRIPTION OF THE ACCOMPANYING DRAWINGS

Figure 1:
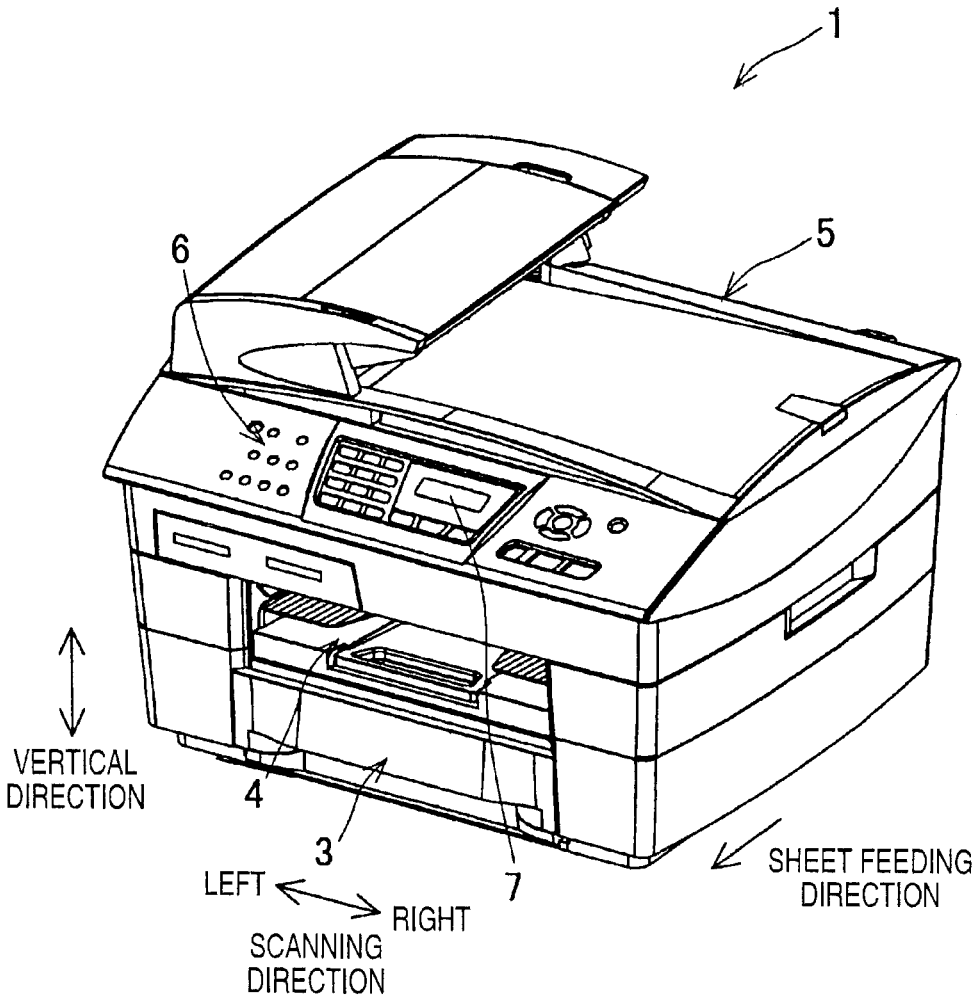
FIG. 1 is a perspective view schematically showing a configuration of an inkjet printer in an embodiment according to one or more aspects of the present invention.
Figure 2:
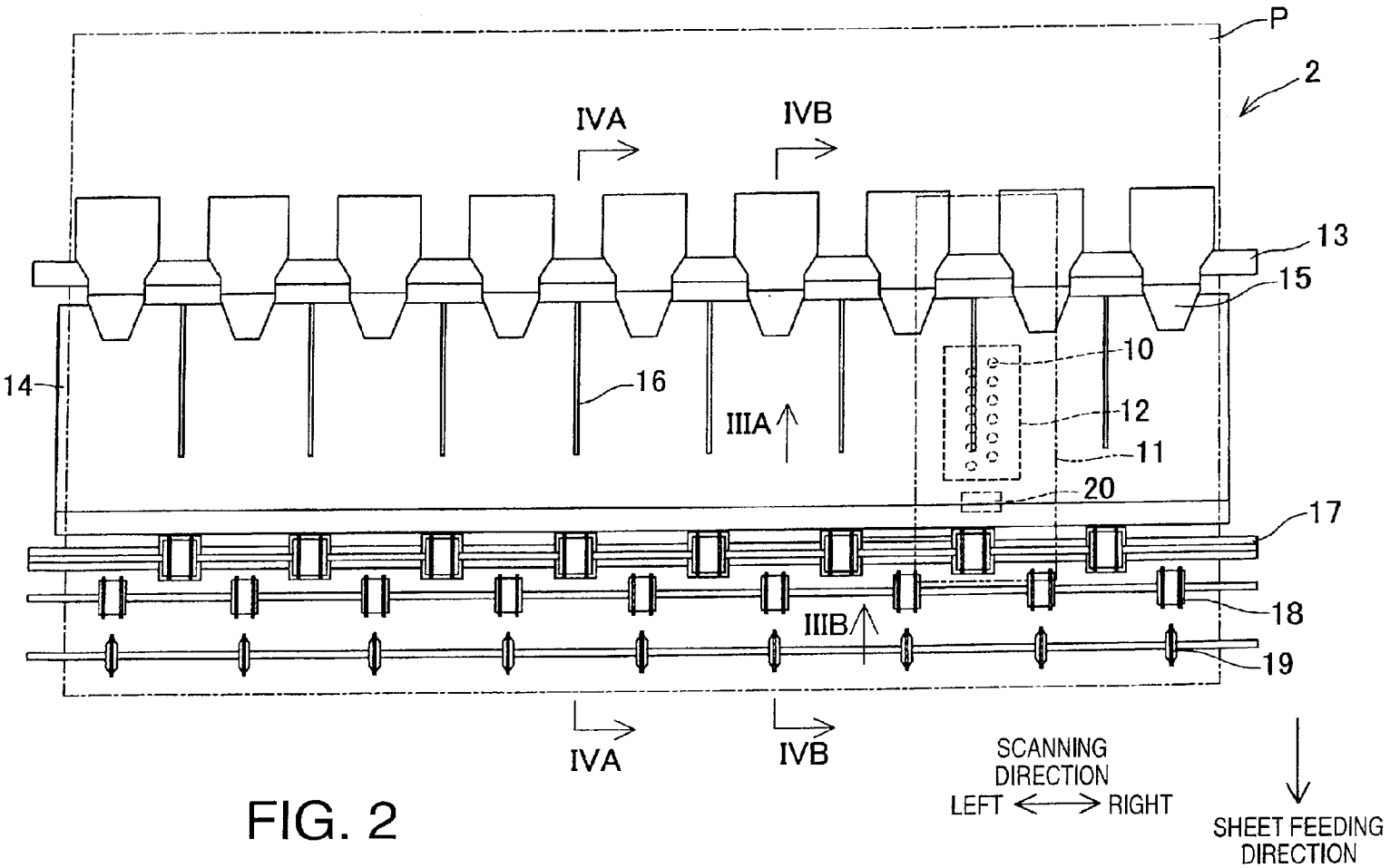
FIG. 2 is a top view of a printing unit of the inkjet printer in the embodiment according to one or more aspects of the present invention.
Figure 3A:
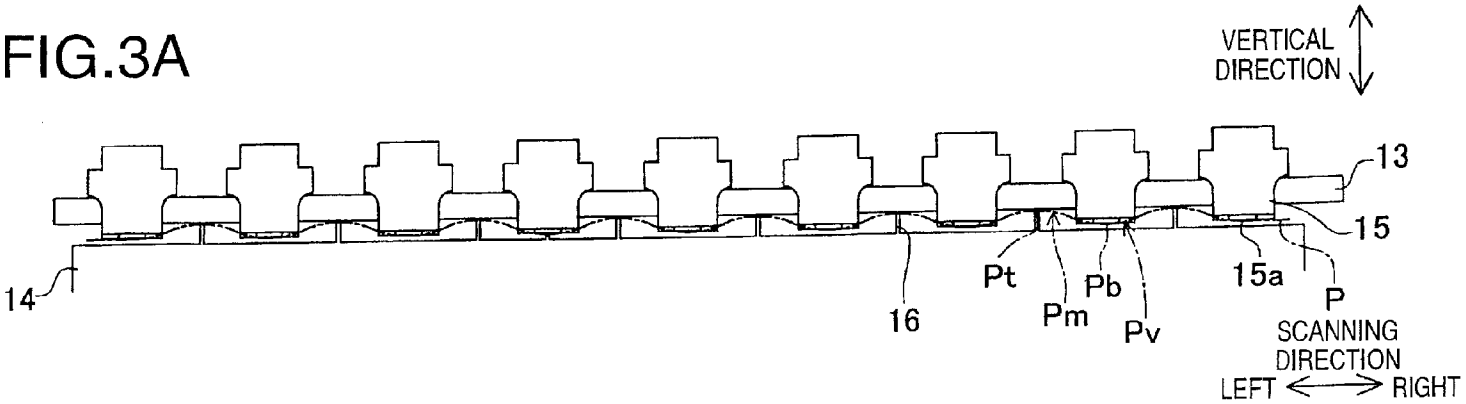

FIG. 3A schematically shows a part of the printing unit when viewed along an arrow IIIA shown in FIG. 2 in the embodiment according to one or more aspects of the present invention.

Figure 3B:
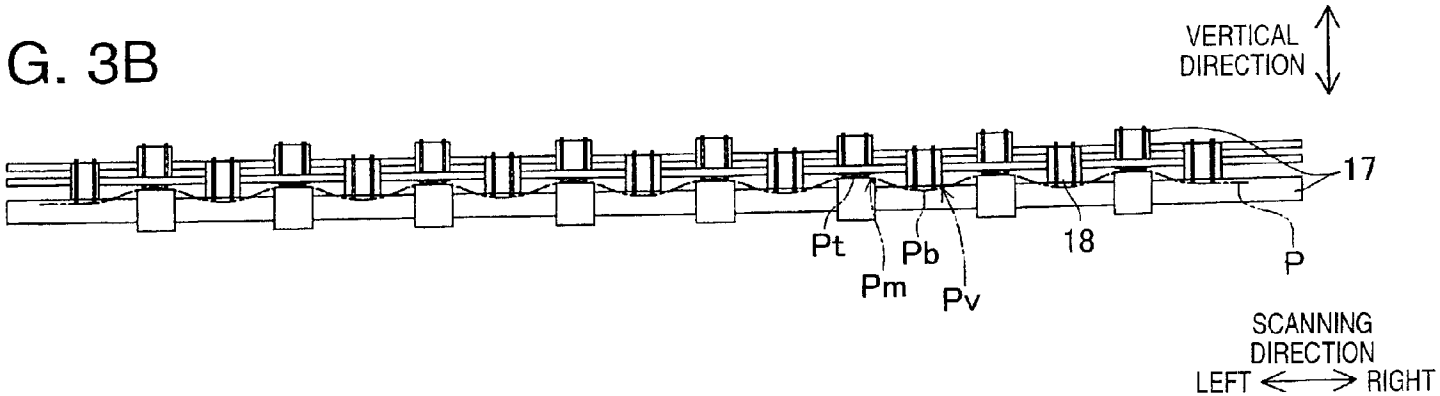

FIG. 3B schematically shows a part of the printing unit when viewed along an arrow IIIB shown in FIG. 2 in the embodiment according to one or more aspects of the present invention.

Figure 4A:
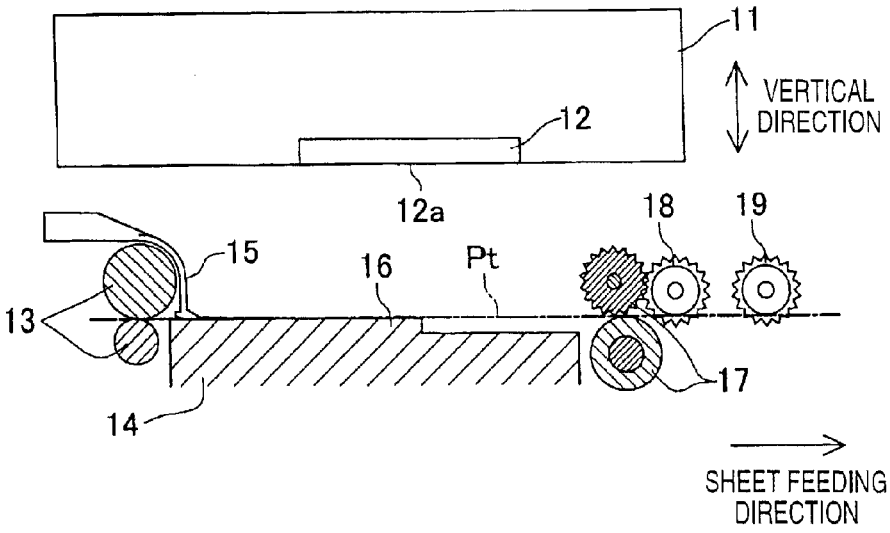

FIG. 4A is a cross-sectional view taken along a line IVA-IVA shown in FIG. 2 in the embodiment according to one or more aspects of the present invention.

Figure 4B:
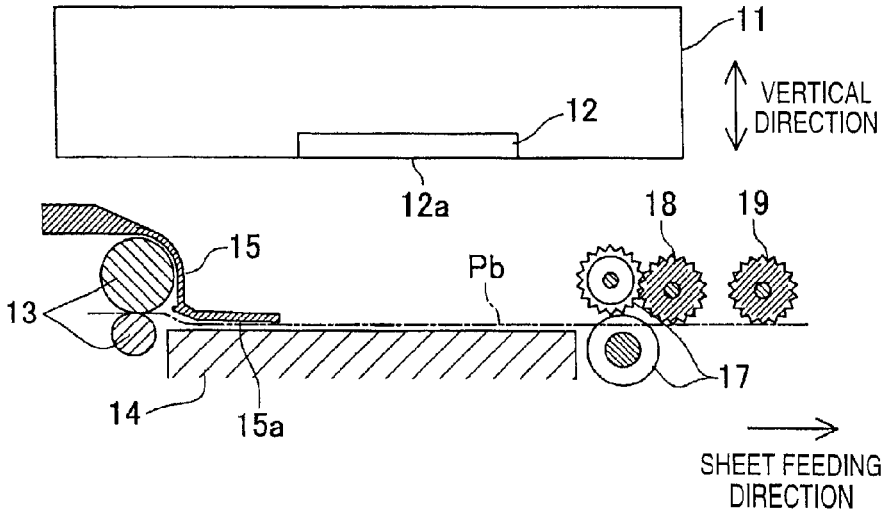

FIG. 4B is a cross-sectional view taken along a line IVB-IVB shown in FIG. 2 in the embodiment according to one or more aspects of the present invention.

Figure 5:
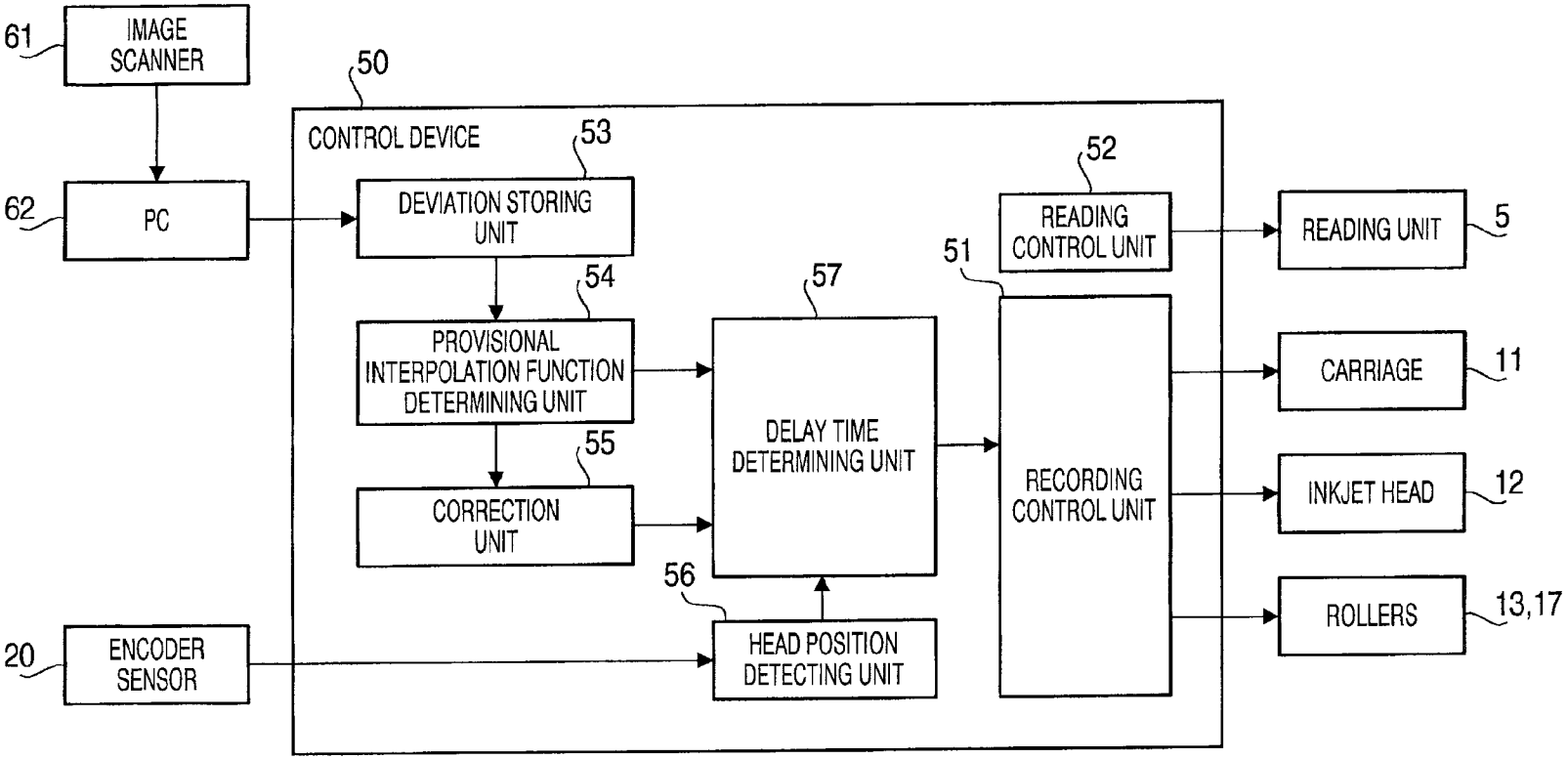

FIG. 5 is a functional block diagram of a control device of the inkjet printer in the embodiment according to one or more aspects of the present invention.

Figure 6:
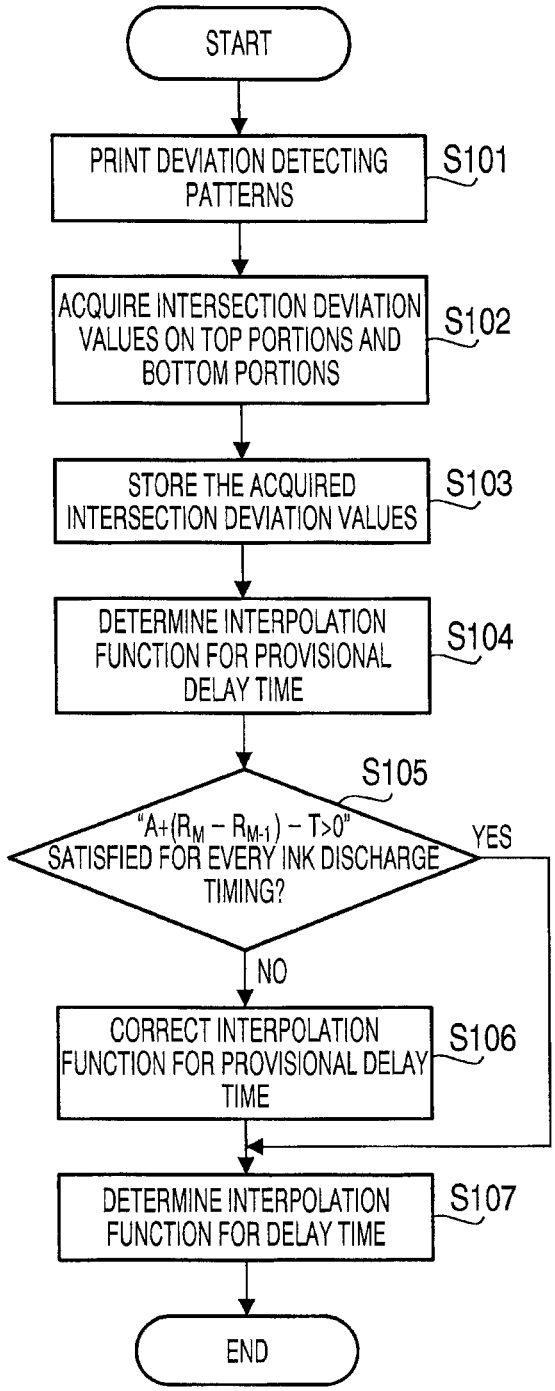

FIG. 6 is a flowchart showing a process to be executed in advance of a printing operation, in a procedure to determine ink discharging timings (moments) to discharge ink droplets from nozzles in the inkjet printer, in the embodiment according to one or more aspects of the present invention.

Figure 7A:
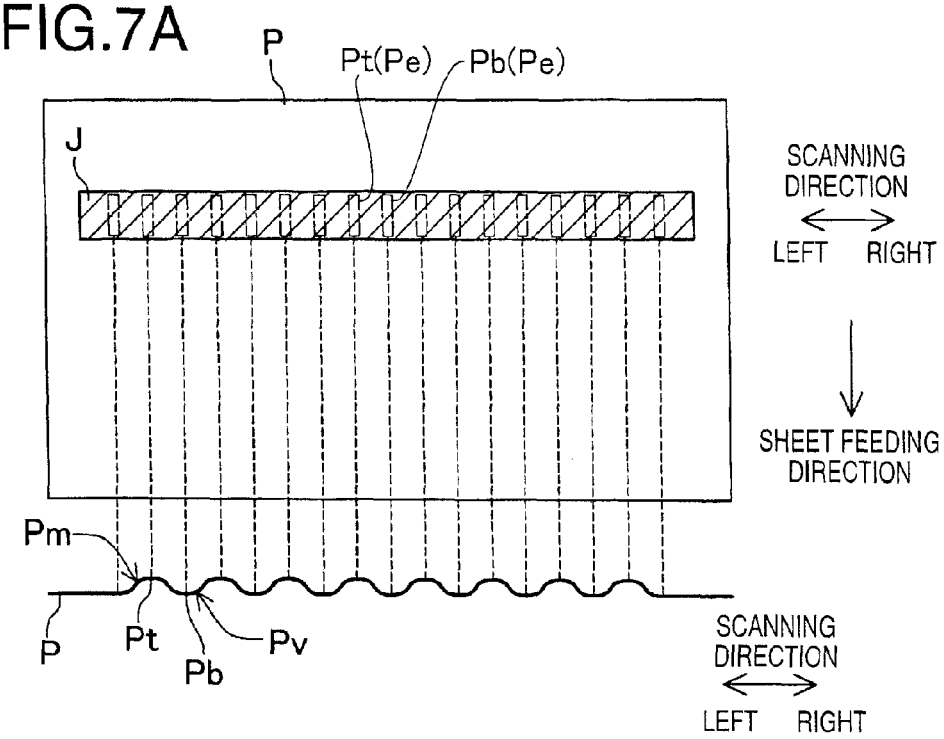

FIG. 7A shows sections to be read of a patch that includes a plurality of deviation detecting patterns printed on a recording sheet in the embodiment according to one or more aspects of the present invention.

Figure 7B:
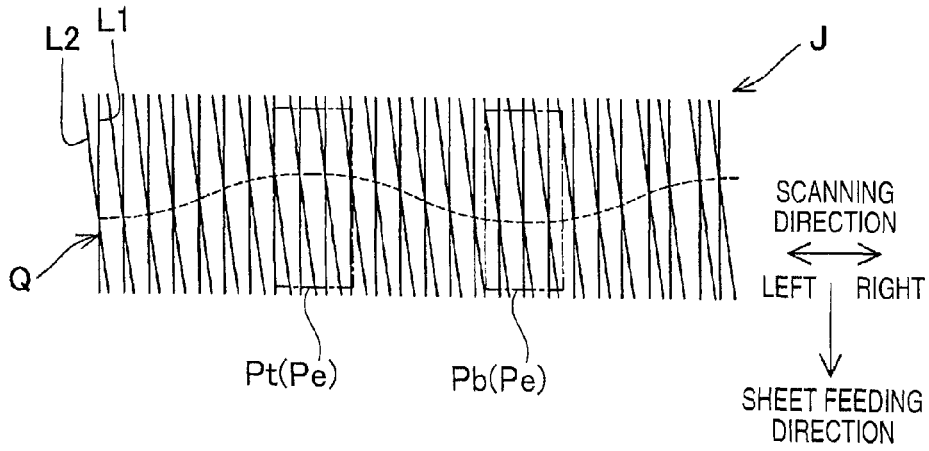

FIG. 7B is an enlarged view partially showing the patch that includes the plurality of deviation detecting patterns printed on the recording sheet in the embodiment according to one or more aspects of the present invention.

Figure 8A:
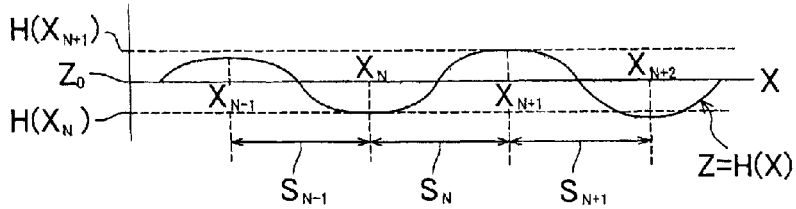

FIG. 8A shows a relationship between a position in a scanning direction on the recording sheet and a height of the recording sheet in the embodiment according to one or more aspects of the present invention.

Figure 8B:
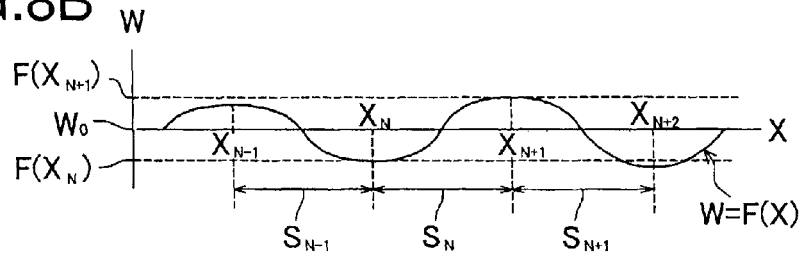

FIG. 8B shows a relationship between the position in the scanning direction on the recording sheet and a positional deviation value in the scanning direction of an ink droplet landing in the position on the recording sheet in the embodiment according to one or more aspects of the present invention.

Figure 8C:
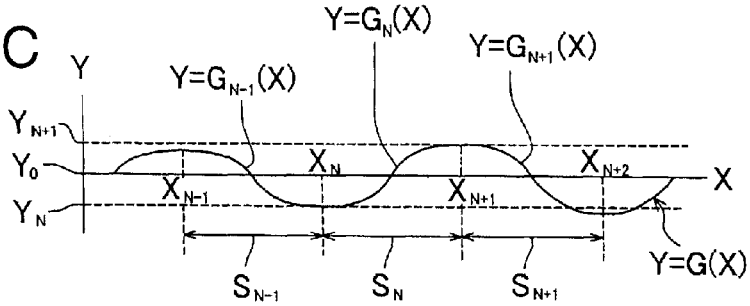

FIG. 8C shows a relationship between the position in the scanning direction on the recording sheet and an intersection deviation value in a sheet feeding direction of a pattern intersection formed in the position on the recording sheet in the embodiment according to one or more aspects of the present invention.

Figure 8D:
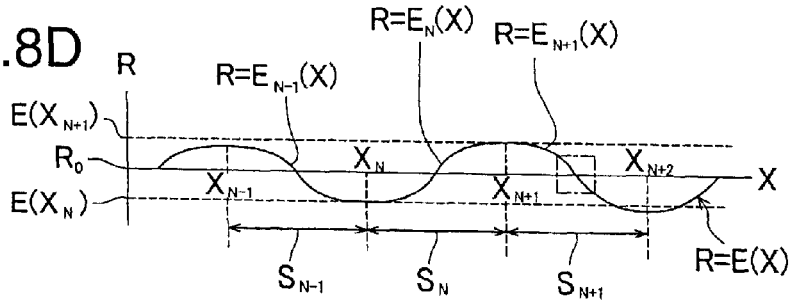

FIG. 8D shows a relationship between the position in the scanning direction on the recording sheet and a provisional delay time for adjusting the ink discharging timing in the embodiment according to one or more aspects of the present invention.

Figure 9A:
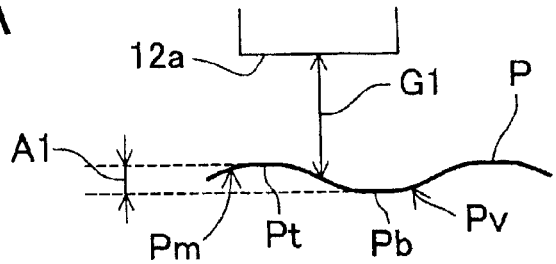
Figure 9B:
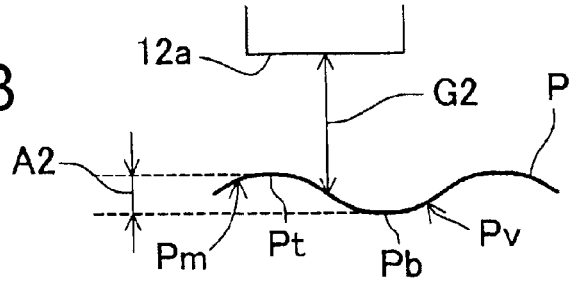
Figure 9C:
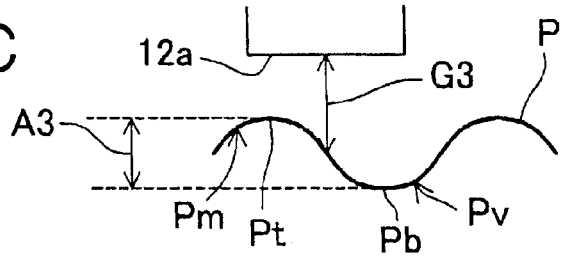

FIGS. 9A to 9C show variations of an average gap and an amplitude of a wave shape of the recording sheet depending on a position of the recording sheet in the sheet feeding direction in the embodiment according to one or more aspects of the present invention.

Figure 10A:
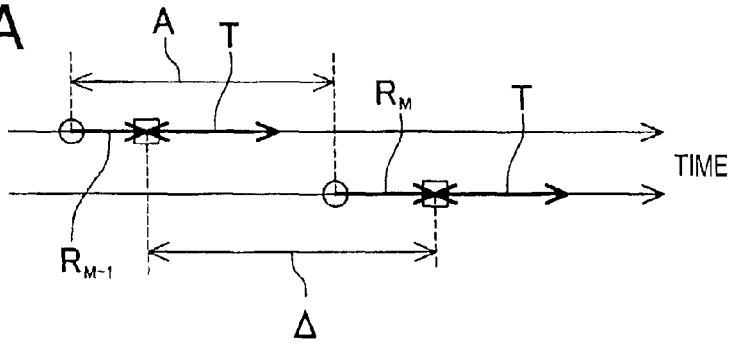

FIG. 10A shows a relationship between reference discharge timing (moment) and actual ink discharge timing (moment) in the case where a predetermined relational expression is satisfied in the sheet feeding direction in the embodiment according to one or more aspects of the present invention.

Figure 10B:
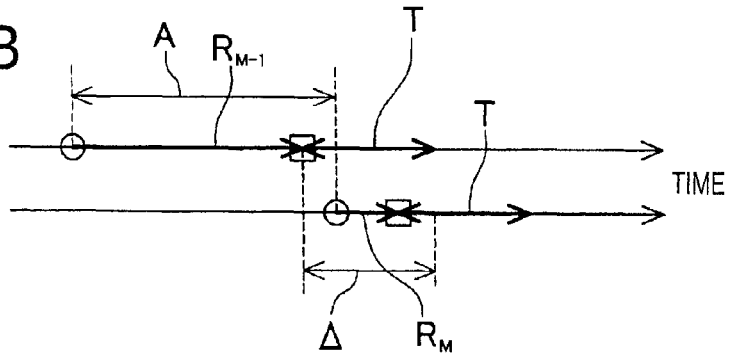
Figure 10C:
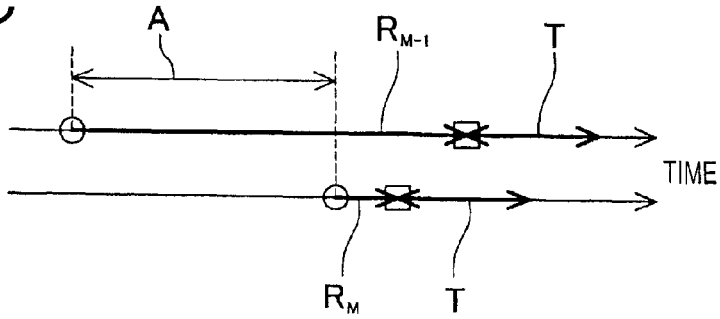

FIGS. 10B and 10C exemplify relationships between the reference discharge timing and the actual ink discharge timing in the case where the predetermined relational expression is not satisfied in the sheet feeding direction in the embodiment according to one or more aspects of the present invention.

Figure 11:
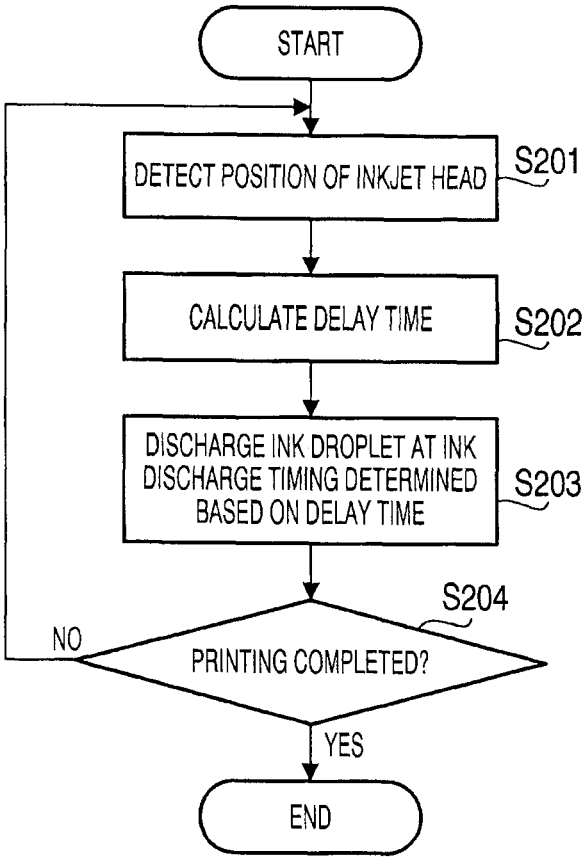

FIG. 11 is a flowchart showing a process to be executed in the printing operation, in the procedure to determine the ink discharge timing in the embodiment according to one or more aspects of the present invention.

Figure 12:
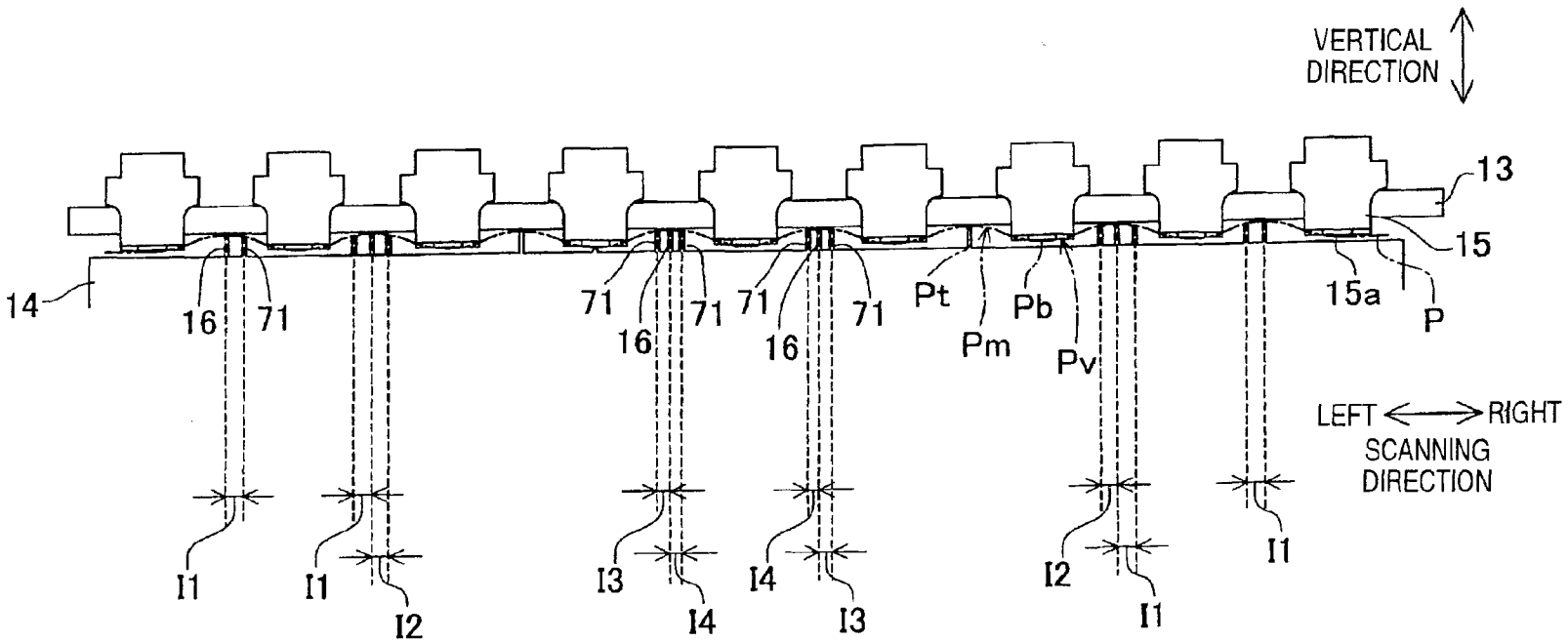

FIG. 12 schematically shows a part of a printing unit when viewed along an arrow equivalent to the arrow IIIA shown in FIG. 2 in a modification according to one or more aspects of the present invention.

Figure 13A:
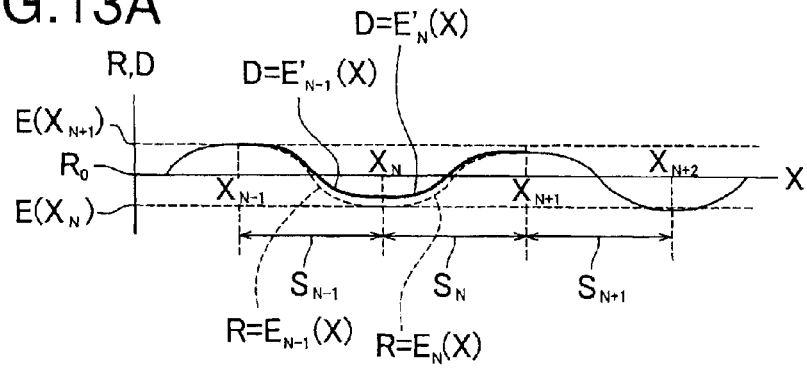
Figure 13B:
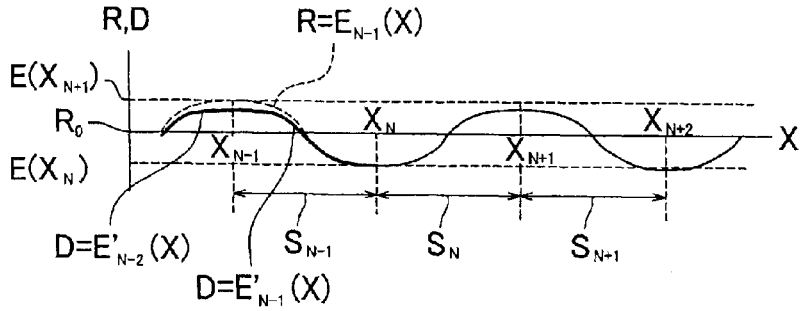
Figure 13C:
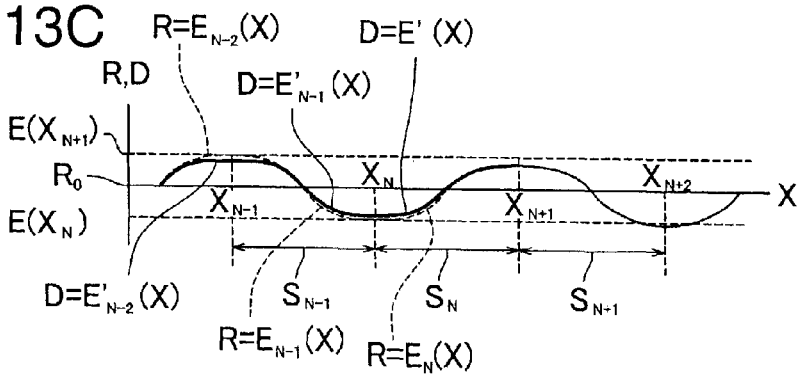

FIGS. 13A, 13B, and 13C exemplify the provisional delay time and a corrected delay time for adjusting the ink discharging timing as a function of the position in the scanning direction on the recording sheet in the modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) orin computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is disposed inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured, e.g., as an image scanner, to read images. The operation unit 6 is provided with buttons. A user is allowed to operate the inkjet printer 1 via the buttons of the operation unit 6. The display unit 7 is configured, e.g., as a liquid crystal display, to display information necessary in the use of the inkjet printer 1.

Subsequently, the printing unit 2 will be described. As shown in FIGS. 2 to 4, the printing unit 2 includes a carriage 11, an inkjet head 12, feed rollers 13, a platen 14, a plurality of corrugated plates 15, a plurality of ribs 16, ejection rollers 17, and a plurality of corrugated spur wheels 18 and 19. It is noted that, for the sake of easy visual understanding in FIG. 2, the carriage 11 is indicated by a long dashed double-short dashed line, and portions disposed below the carriage 11 are indicated by solid lines.

The carriage 11 is configured to reciprocate along a scanning direction while guided by a guiderail (not shown). The inkjet head 12 is mounted on the carriage 11. The inkjet head 12 is configured to discharge ink droplets from a plurality of nozzles 10 formed in an ink discharge surface 12*a* that is a lower surface of the inkjet head 12.

The feed rollers 13 are two rollers configured to pinch therebetween the recording sheet P fed by the sheet feeding unit 3 and feed the recording sheet P in a sheet feeding direction perpendicular to the scanning direction. The platen 14 is disposed to face the ink discharge surface 12*a*. The recording sheet P is fed by the feed rollers 13, along an upper surface of the platen 14.

The plurality of corrugated plates 15 are disposed to face an upper surface of an upstream end of the platen 14 in the sheet feeding direction. The plurality of corrugated plates 15 are arranged at substantially regular intervals along the scanning direction. The recording sheet P, fed by the feed rollers 13, passes between the platen 14 and the corrugated plates 15. At this time, the recording sheet P is pressed from above by pressing surfaces 15*a* that are lower surfaces of the plurality of corrugated plates 15.

Each individual rib 16 is disposed between corresponding two mutually-adjacent corrugated plates 15 in the scanning direction, on the upper surface of the platen 14. The plurality of ribs 16 are arranged at substantially regular intervals along the scanning direction. Each rib 16 protrudes from the upper surface of the platen 14 up to a level higher than the pressing surfaces 15*a* of the corrugated plates 15. Each rib 16 extends from an upstream end of the platen 14 toward a downstream side in the sheet feeding direction. Thereby, the recording sheet P on the platen 14 is supported from underneath by the plurality of ribs 16.

The ejection rollers 17 are two rollers configured to pinch therebetween portions of the recording sheet P that are located in the same positions as the plurality of ribs 16 in the scanning direction and feed the recording sheet P toward the sheet ejecting unit 4. An upper one of the ejection rollers 17 is provided with spur wheels so as to prevent the ink attached onto the recording sheet P from transferring to the upper ejection roller 17.

The plurality of corrugated spur wheels 18 are disposed substantially in the same positions as the corrugated plates 15 in the scanning direction, at a downstream side relative to the ejection rollers 17 in the sheet feeding direction. The plurality of corrugated spur wheels 19 are disposed substantially in the same positions as the corrugated plates 15 in the scanning direction, at a downstream side relative to the corrugated spur wheels 18 in the sheet feeding direction. In addition, the plurality of corrugated spur wheels 18 and 19 are placed at a level lower than a position where the ejection rollers 17 pinch the recording sheet P therebetween, in the vertical direction. The plurality of corrugated spur wheels 18 and 19 are configured to press the recording sheet P from above at the level. Further, each of the plurality of corrugated spur wheels 18 and 19 is not a roller having a flat outer circumferential surface but a spur wheel. Therefore, it is possible to prevent the ink attached onto the recording sheet P from transferring to the plurality of corrugated spur wheels 18 and 19.

Thus, the recording sheet P on the platen 14 is pressed from above by the plurality of corrugated plates 15 and the plurality of corrugated spur wheels 18 and 19, and is supported from underneath by the plurality of ribs 16. Thereby, as shown in FIGS. 3A and 3B, the recording sheet P on the platen 14 is deformed and held in such a wave shape that mountain portions Pm protruding upward (i.e., toward the ink discharge surface 12*a*) and valley portions Pv recessed downward (i.e., in a direction opposite to the direction toward the ink discharge surface 12*a*) are alternately arranged. Further, each mountain portion Pm has a top portion (peak portion) Pt, protruding up to the highest level of the mountain portion Pm, which is located substantially in the same position as a center of the corresponding rib 16 in the scanning direction. Each valley portion Pv has a bottom portion Pb, recessed down to the lowest level of the valley portion Pv, which is located substantially in the same position as the corresponding corrugated plate 15 and the corresponding corrugated spur wheels 18 and 19.

An encoder sensor 20 is mounted on the carriage 11. The encoder sensor 20, together with an encoder belt (not shown) extending along the scanning direction, forms a linear encoder. The encoder sensor 20 is configured to detect slits formed in the encoder belt and thereby detect a position of the inkjet head 12 moving together with the carriage 11 along the scanning direction.

The printing unit 2 configured as above performs printing on the recording sheet P, by discharging ink droplets from the inkjet head 12 reciprocating together with the carriage 11 along the scanning direction while feeding the recording sheet P in the sheet feeding direction by the feed rollers 13 and the ejection rollers 17.

Next, an explanation will be provided about the control device 50 for controlling the operations of the inkjet printer 1. The control device 50 includes a central processing unit (CPU), a read only memory (ROM), a random access memory (RAM), and control circuits. Thereby, as shown in FIG. 5, the control device 50 is configured to serve as a plurality of units such as a recording control unit 51, a reading control unit 52, a deviation storing unit 53, a provisional interpolation function determining unit 54, a correction unit 55, a head position detecting unit 56, and a delay time determining unit 57.

The recording control unit 51 is configured to control operations of the carriage 11, the inkjet head 12, the feed rollers 13, and the ejection rollers 17 when the inkjet printer 1 performs a printing operation. The reading control unit 52 is configured to control operations of the reading unit 5 in an image reading operation.

As will be described later, the deviation storing unit 53 is configured to store (retain) a deviation value (hereinafter, which may be referred to as an intersection deviation value) in the sheet feeding direction of an intersection between two lines of a deviation detecting pattern formed on each individual portion of the plurality of top portions Pt and the plurality of bottom portions Pb. The provisional interpolation function determining unit 54 is configured to determine, from the intersection deviation values stored in the deviation storing unit 53, an interpolation function E(X) for calculating a provisional delay time, which is a provisional value of a delay time with respect to a reference discharge timing (moment) for an ink discharge timing (moment) to discharge an ink droplet into each individual position on the wave-shaped recording sheet P in the scanning direction. It is noted that the term "timing," which will frequently be referred to in the following description, may have the same meaning as "a moment" or "a time."

The correction unit 55 is configured to correct the interpolation function E(X) in the case where it is impossible to perform a normal ink discharging operation when the ink discharge timing is set as a moment delayed with respect to (later than) the reference discharge timing by the provisional delay time calculated by the interpolation function E(X), as will be described later.

The head position detecting unit 56 is configured to detect a position of the inkjet head 12 reciprocating together with the carriage 11 along the scanning direction in the printing operation, from a result of detection by the encoder sensor 20. The delay time determining unit 57 is configured to determine a final delay time, based on the provisional delay time calculated by the interpolation function E(X), the delay time determined through the correction by the correction unit 55, and the position of the inkjet head 12 detected by the head position detecting unit 56.

Subsequently, an explanation will be provided about a procedure, in the inkjet printer 1, for determining the ink discharge timings (the delay times) to discharge ink droplets from the nozzles 10 and performing the printing operation. In order to determine the ink discharge timings (moments) to discharge ink droplets from the nozzles 10 and perform the printing operation, as will be described below, it is required to previously perform steps S101 to S107 shown in FIG. 6 in advance of execution of the printing operation using the inkjet printer 1 (e.g., at a stage of manufacturing the inkjet printer 1). Then, when performing the printing operation, the inkjet printer 1 performs steps S201 to S204 shown in FIG. 11.

In S101, the control device 50 controls the printing unit 2 to print on the recording sheet P a patch J, which includes a plurality of deviation detecting patterns Q as shown in FIGS. 7A and 7B. More specifically, for instance, the control device 50 controls the printing unit 2 to print a plurality of straight lines L1, which extend in parallel with the sheet feeding direction and are arranged along the scanning direction, by discharging ink droplets from the nozzles 10 while moving the carriage 11 toward one side along the scanning direction. After that, the control device 50 controls the printing unit 2 to print a plurality of straight lines L2, which are tilted with respect to the sheet feeding direction and intersect the plurality of straight lines L1, respectively, by discharging ink droplets from the nozzles 10 while moving the carriage 11 toward the other side along the scanning direction. Thereby, as shown in FIGS. 7A and 7B, the patch J is printed that includes the plurality of deviation detecting patterns Q arranged along the scanning direction, each deviation detecting pattern Q including a combination of the mutually intersecting straight lines L1 and L2. It is noted that, at this time, the ink droplets are discharged from the nozzles 10 in accordance with design-based ink discharging timings (moments) determined, for example, based on an assumption that the recording sheet P is not in the wave shape but flat.

In S102, an image scanner 61, which is provided separately from the inkjet printer 1, is caused to read the plurality of deviation detecting patterns Q printed in S101. Further, in S102, a PC 62, which is connected with the image scanner 61, is caused to acquire the intersection deviation value on each individual portion of the plurality of top portions Pt and the plurality of bottom portions Pb, from the read deviation detecting patterns Q. It is noted that, instead of the image scanner 61, the reading unit 5 may read the plurality of deviation detecting patterns Q. Further, instead of the PC 62, the control device 50 may acquire the intersection deviation value on each individual portion of the plurality of top portions Pt and the plurality of bottom portions Pb, from the read deviation detecting patterns Q.

More specifically, for example, when the deviation detecting patterns Q as shown in FIGS. 7A and 7B are printed in a situation where there is a deviation between an ink landing position when the carriage 11 is moved rightward along the scanning direction and an ink landing position when the carriage 11 is moved leftward along the scanning direction, the straight line L1 and the straight line L2 of a deviation detecting pattern Q are printed to be deviated from each other in the scanning direction. Therefore, the straight line L1 and the straight line L2 form an intersection thereof (hereinafter referred to as a pattern intersection) in a position deviated in the sheet feeding direction depending on a positional deviation value in the scanning direction between the ink landing positions. Further, when the reading unit 5 reads each deviation detecting pattern Q, the reading unit 5 detects a higher brightness at the pattern intersection than the brightness at any other portion of the read deviation detecting pattern Q. This is because a ratio of areas (black) of the straight lines L1 and L2 relative to background areas (white) of the recording sheet P is smaller at the pattern intersection than at any other portion. Accordingly, by reading each deviation detecting pattern Q and acquiring a position where the highest brightness is detected within the read deviation detecting pattern Q, it is possible to detect the position of the intersection of the straight lines L1 and L2 in the sheet feeding direction.

A positional deviation in the sheet feeding direction of the intersection of the straight lines L1 and L2 is proportional to a positional deviation in the scanning direction of the intersection of the straight lines L1 and L2. Specifically, when a relative slope (inclination) between the straight lines L1 and L2 is described by a ratio of "a component in the sheet feeding direction:a component in the scanning direction" equal to "10:1," the positional deviation in the sheet feeding direction of the intersection of the straight lines L1 and L2 is ten times as large as the positional deviation in the scanning direction of the intersection of the straight lines L1 and L2. In general, when an angle between the straight lines L1 and L2 is θ, the positional deviation in the sheet feeding direction of the intersection of the straight lines L1 and L2 is 1/tan θ times as large as the positional deviation in the scanning direction of the intersection of the straight lines L1 and L2. Thus, by detecting the intersection deviation value of a pattern intersection in the sheet feeding direction, it is possible to acquire information on a positional deviation value in the scanning direction between ink landing positions in bidirectional printing.

In the embodiment, the intersection deviation value on each individual portion of the top portions Pt and the bottom portions Pb is acquired by reading deviation detecting patterns Q printed on the corresponding portion of the top portions Pt and the bottom portions Pb of the recording sheet P (see sections surrounded by alternate long and short dash lines in FIG. 7A, which may hereinafter be referred to as examined sections Pe).

As described above, in S102, only the deviation detecting patterns Q printed on the top portions Pt and the bottom portions Pb of the recording sheet P are read out. Therefore, in S101, it is only necessary to print the deviation detecting patterns Q at least on the top portions Pt and the bottom portions Pb of the recording sheet P.

In S103, as indicated by a dashed line in FIG. 5, the deviation storing unit 53 is communicably connected with the PC 62, and is caused to store the intersection deviation value, acquired in S102, on each individual portion of the top portions Pt and the bottom portions Pb. It is noted that the connection between the deviation storing unit 53 and the PC 62 may be established at any time before S103.

In S104, the control device 50 (the provisional interpolation function determining unit 54) determines the interpolation function E(X) for calculating the provisional delay time for each ink discharge timing (moment), from the intersection deviation values on the top portions Pt and the bottom portions Pb stored in the deviation storing unit 53 in S103.

More specifically, when the recording sheet P is held in the wave shape along the scanning direction as described above, the wave shape is expressed as shown in FIG. 8A using a position X in the scanning direction (the horizontal axis) and a height Z in the vertical direction (the vertical axis). Here, "$X_N$" represents a position of an N-th examined section Pe in the scanning direction. "$S_N$" represents a segment from "$X=X_N$" to "$X=X_{N+1}$." In FIG. 8A, values of the height Z over a whole length of the recording sheet P in the scanning direction are expressed as "Z=H(X)" that is a function of "X." Here, "$Z_0$" is an average value of the height Z.

FIG. 8B shows a positional deviation value W of the ink landing position in the scanning direction (the vertical axis), which is expressed as "W=F(X)" that is a function of the position X in the scanning direction (the horizontal axis). In the following description, "$W_0$" is a positional deviation value W of the ink landing position in the scanning direction when $Z=Z_0$. According to an equation "(a moving distance of an ink droplet)=(a velocity of the ink droplet)×(a flying time of the ink droplet)," since the ink droplet moves in the vertical direction and the scanning direction within the same flying time, the following equation is established: "(a moving distance of the ink droplet in the vertical direction)/(a velocity of the ink droplet in the vertical direction)=(a moving distance of the ink droplet in the scanning direction)/(a velocity of the ink droplet in the scanning direction)." Namely, an equation "$(Z-Z_0)/U=(W-W_0)/V$" is established, where "V" represents a moving velocity of the carriage 11 in the scanning direction, and "U" represents a flying velocity of the ink droplet in the vertical direction. Here, "$Z_0$," "$W_0$" "U," and "V" are constant values that do not depend on the value of "X." Therefore, the functions "Z=H(X)" and "W=F(X)" provide substantially similar wave shapes. Further, FIG. 8C shows an intersection deviation value Y of the pattern intersection in the sheet feeding direction (the vertical axis), which is expressed as "Y=G(X)" that is a function of the position X in the scanning direction (the horizontal axis). As described above, since Y=W/tan θ, the function "Y=G(X)" provides a wave shape similar to the wave shapes of "Z=H(X)" and "W=F(X)." Here, "$Y_0$" is a value of the intersection deviation value Y when $Z=Z_0$.

Accordingly, as shown in FIG. 8B, the variation of the positional deviation value W of the ink landing position in the scanning direction as a function of the position X in the scanning direction is expressed as a graph that can be rendered coincident with a graph for representing the variation of the height Z of the recording sheet P by scaling and translation along the vertical axis. Likewise, as shown in FIG. 8C, the variation of the intersection deviation value Y of the pattern intersection in the sheet feeding direction as a function of the position X in the scanning direction is expressed as a graph that can be rendered coincident with the graph for representing the variation of the height Z of the recording sheet P by scaling and translation along the vertical axis. Namely, the graph of the interpolation function G(X) for the intersection deviation value Y is transformed by scaling and translation along the vertical axis, into the graph of the interpolation function H(X) for the height Z of the recording sheet P and into the graph of the interpolation function F(X) for the positional deviation value W of the ink landing position.

Further, when a provisional delay time R is expressed as "R=E(X)" that is a function of the position X in the scanning direction, from an amount of change in the ink discharge timing and the positional deviation of the ink landing position, an equality "$F(X)-W_0=V\cdot(E(X)-R_0)$" holds. Further, an equality "$[H(X)-Z_0]:[F(X)-W_0]=U:V$" and an equality "$[F(X)-W_0]:[G(X)-Y_0]=\sin\theta:\cos\theta$" hold. From these equations, the interpolation function E(X) for the provisional delay time R is represented by the following expression 1. Thus, it is understood that it is possible to determine the interpolation function E(X) for the provisional delay time R based on the interpolation function G(X) for the intersection deviation value Y.

$$E(X)=\frac{\tan\theta}{V}\cdot(G(x)-Y_0)+R_0 \qquad \text{[Expression 1]}$$

FIG. 8D is a graph for showing the function"R=E(X)." The graph shown in FIG. 8D is rendered coincident with the graphs shown in FIGS. 8A to 8C by scaling and translation along the vertical axis. Here, "$R_0$" is a value of the provisional delay time R when $Z=Z_0$. In the embodiment, the inkjet head 12 is controlled to discharge an ink droplet from the nozzles 10 in response to a signal issued by the encoder sensor 20 when the inkjet head 12 reaches a predetermined position. Therefore, it is difficult to discharge an ink droplet at an ink discharge timing (moment) earlier than the reference discharge timing. Accordingly, a base delay time $R_0$ in the interpolation function E(X) for the provisional delay time R is set in such a manner that a relational expression "R≥0" is always satisfied. Here, the base delay time $R_0$ is a provisional delay time when the gap between the ink discharge surface 12*a* and the recording sheet P is equal to an average value thereof in the scanning direction.

Further, when the recording sheet P is held in the wave shape, a provisional delay time for an ink discharge timing to discharge an ink droplet onto each individual top portion Pt is a predetermined time period longer than the base delay time $R_0$. In addition, a provisional delay time for an ink discharge timing to discharge an ink droplet onto each individual bottom portion Pb is a predetermined time period shorter than the base delay time $R_0$. Meanwhile, the provisional delay time has a local maximum value at the ink discharge timing to discharge an ink droplet onto each top portion Pt and a local minimum value at the ink discharge timing to discharge an ink droplet onto each bottom portion Pb.

In the embodiment, the base delay time $R_0$ is set to substantially a time $R_{MAX}/2$ that is half as long as an upper limit delay time $R_{MAX}$. The upper limit delay time $R_{MAX}$ is a design-based upper limit value of the delay time that is determined regardless of whether or not a below-mentioned relational expression is satisfied. Thereby, it is possible to extend as much as possible a modifiable range of the provisional delay time for changing (modifying) the provisional delay time depending on a variation of the gap between the ink discharge surface 12*a* and the recording sheet P. Consequently, it is possible to enlarge an amplitude of the wave shape. In this case, a provisional delay time for an ink discharge timing (moment) to discharge an ink droplet onto a bottom portion Pb that requires the shortest delay time is substantially zero, and the relational expression "R≥0" is always satisfied.

Further, the interpolation function E(X) determined as above is compatible with a gap between the ink discharge surface 12*a* and a portion of the recording sheet P where the patch J is printed. However, for instance, an average gap between the ink discharge surface 12*a* and the recording sheet P and the amplitude of the wave shape vary depending on in which portion of the recording sheet P in the sheet feeding direction the patch J is printed (i.e., they vary among a first situation in which the patch J is printed on a leading end of the recording sheet P in the sheet feeding direction where the wave shape is held only by the corrugated plates 15 and the ribs 16, a second situation in which the patch J is printed on a middle portion of the recording sheet P in the sheet feeding direction where the wave shape is held by the corrugated plates 15, the ribs 16, and the corrugated spur wheels 18 and 19, and a third situation in which the patch J is printed on a trailing end of the recording sheet P in the sheet feeding direction where the wave shape is held only by the ribs 16 and the corrugated spur wheels 18 and 19). FIG. 9A shows an average gap G1 and an amplitude A1 of the wave shape in the first situation. FIG. 9B shows an average gap G2 and an amplitude A2 of the wave shape in the second situation. FIG. 9C shows an average gap G3 and an amplitude A3 of the wave shape in the third situation. It is noted that a relationship "G3>G2>G1" holds among the average gaps G1, G2, and G3, and a relationship "A3>A2>A1" holds among the amplitudes A1, A2, and A3.

In the embodiment, the interpolation function E(X) is transformed by scaling and translation along the vertical axis, depending on a position on the recording sheet P in the sheet feeding direction, and the transformed interpolation function E(X) is employed as an interpolation function for the provisional delay time. Further, at this time, depending on the position on the recording sheet P in the sheet feeding direction, the interpolation function E(X) is translated along the vertical axis in such a manner that a base delay time (corresponding to $R_0$ of the transformed interpolation function E(X)) becomes substantially half as long as the upper limit delay time $R_{MAX}$. Thereby, regardless of the position on the recording sheet P in the sheet feeding direction, it is possible to enlarge as much as possible the modifiable range of the provisional delay time for changing (modifying) the provisional delay time depending on the variation of the gap between the ink discharge surface 12*a* and the recording sheet P.

Thus, the four pieces of information (the four functions) shown in FIGS. 8A to 8D are substantially equivalent when the respective relevant constant values are known. Therefore, even when the deviation storing unit 53 stores any one of the four functions, or even when interpolation calculation is made using any one of the four functions, it is possible to correct the positional deviation value of the ink landing position through appropriate transformation for the functions. In the embodiment, the following description will be provided based on an assumption that the deviation storing unit 53 stores the intersection deviation values Y.

The interpolation function G(X) is determined as a polynomial such as a cubic function of the position X or a sine function of the position X, for each individual one of the segments into which the patch J is partitioned by the examined sections Pe in the scanning direction. In FIG. 8C, an interpolation function $G_N(X)$ represents an interpolation function for the intersection deviation values Y (the positional deviations of the pattern intersections in the sheet feeding direction) within a segment $S_N$ defined by two ends, i.e., the N-th examined section Pe and the (N+1)-th examined section Pe from the left side in the scanning direction. Then, based on the determined interpolation function G(X) for the intersection deviation value Y, the interpolation function E(X) for the provisional delay time R is determined. It is noted that an interpolation function $E_N(X)$ shown in FIG. 8D is a function corresponding to the interpolation function $G_N(X)$.

In S105, with respect to the provisional delay time calculated based on the interpolation function E(X) determined in S104, the control device 50 determines whether a relational expression "$A+(R_M-R_{M-1})-T>0$" is satisfied for every ink discharge timing. Here, "$R_M$" represents a provisional delay time for a certain ink discharge timing (moment) (a later ink discharge timing). "$R_{M-1}$" represents a provisional delay time for an earlier ink discharge timing (moment) just before the later ink discharge timing. "A" represents a time interval between two successive reference discharge timings (moments). "T" represents a predetermined time period required for an operation to be executed by the inkjet head 12 when discharging an ink droplet from a nozzle 10 and forming a single dot. Specifically, for instance, T is a summation of time periods such as a time period required for driving the inkjet head 12 to discharge the ink droplet from the nozzle 10 and a time period required for driving the inkjet head 12 to bring down a variation of a pressure of ink in the inkjet head 12 after discharging the ink droplet.

When determining that the relational expression "$A+(R_M-R_{M-1})-T>0$" is satisfied for every ink discharge timing (S105: Yes), the control device 50 determines the interpolation function E(X) determined in S104, as an interpolation function for the delay time (S106). Meanwhile, when determining that a relational expression "$A+(R_M-R_{M-1})-T\leq 0$" holds for an ink discharge timing (moment) (S105: No), as will be described later, the control device 50 (the correction unit 55) corrects the interpolation function E(X) (S106). Then, the control device 50 determines the corrected interpolation function E'(X) as the interpolation function for the delay time (S107).

Subsequently, explanations will be provided about a case where the relational expression "$A+(R_M-R_{M-1})-T>0$" holds and a case where the relational expression "$A+(R_M-R_{M-1})-T\leq 0$" holds. FIGS. 10A, 10B, and 10C each shows a relationship between a reference discharge timing (moment) (indicated by a circle) and an ink discharge timing (moment) (indicated by a quadrangle) delayed by a provisional delay time, for each of a later ink discharge timing and an earlier ink discharge timing just before the later ink discharge timing.

When the relational expression "$A+(R_M-R_{M-1})-T>0$" is satisfied, as shown in FIG. 10A, a time interval $\Delta$ ($=A+(R_M-R_{M-1})$) between the later ink discharge timing and the earlier ink discharge timing just before the later ink discharge timing is longer than the aforementioned predetermined time period T. Therefore, the later ink discharge timing is a moment after a lapse of the predetermined time period from the earlier ink discharge timing. Accordingly, it is possible to perform a normal ink discharging operation to sequentially discharge ink droplets from the nozzles 10 in the printing operation.

Meanwhile, when $A+(R_M-R_{M-1})-T\leq 0$, the time interval $\Delta$ is equal to or shorter than the aforementioned predetermined time period T. Therefore, as shown in FIG. 10B, the later ink discharge timing might be a moment before a lapse of the predetermined time period from the earlier ink discharge timing. Alternatively, as shown in FIG. 10C, the later ink discharge timing might be a moment before the earlier ink discharge timing. In these cases, it is impossible to perform the normal ink discharging operation.

An explanation will be provided about the correction of the interpolation function E(X) in S105. When the provisional delay time $R_M$ for the later ink discharge timing is shorter than the provisional delay time $R_{M-1}$ for the earlier ink discharge timing, a difference "$R_M-R_{M-1}$" is a negative with a large absolute value, and the relational expression "$A+(R_M-R_{M-1})-T\leq 0$" holds. For instance, when the carriage 11 moves rightward along the scanning direction, the change "$R_M-R_{M-1}$" between the provisional delay times is a negative with the maximum absolute value in a central position in the scanning direction (in the case of a segment $S_{N+1}$, $(X_{N+1}+X_{N+2})/2$) of a segment $S_{N+1}$ such as a segment $S_{N+1}$ having a top portion Pt at an upstream end thereof and a bottom portion Pb at a downstream end thereof in the moving direction of the carriage 11.

In the embodiment, in S105, for instance, the control device 50 sequentially determines the provisional delay time for each individual ink discharge timing (moment) in an order from the earliest ink discharge timing (moment). Then, when the relational expression "$A+(R_M-R_{M-1})-T\leq 0$" holds for a certain ink discharge timing, the provisional delay time $R_M$ for the certain ink discharge timing is replaced with a predetermined replacement delay time $K_M$. Here, the replacement delay time $K_M$ is such a delay time as to satisfy an equality "$A+(K_M-R_{M-1})-T=B$ (where "B" is a positive constant value)." Thereby, when the difference "$R_M-R_{M-1}$" between the provisional delay times exceeds an upper limit ($=B-A+T$), $R_M$ is replaced with $K_M$, and a difference "$D_M-D_{M-1}$" between corrected delay times becomes the upper limit. Thus, the difference "$D_M-D_{M-1}$" between corrected delay times does not exceed the upper limit (i.e., the difference "$D_M-D_{M-1}$" between corrected delay times is equal to or less than the upper limit).

When the above correction is implemented, the corrected interpolation function E'(X) has the replacement delay time $K_M$ in a position X corresponding to each ink discharge timing for which the relational expression "$A+(R_M-R_{M-1})-T\leq 0$" holds, and has the same values as the provisional delay times $R_M$ of the interpolation function E(X) in the other positions X. In the embodiment, for instance, a provisional delay time $R_M$ for an ink discharge timing (moment) to discharge an ink droplet onto an area around the position $X=(X_N+X_{N+1})/2$ (an area surrounded by an alternate long and short dash line in FIG. 8D) is replaced with the replacement delay time $K_M$.

Thus, a relational expression regarding the delay time "$A+(D_M-D_{M-1})-T>0$" is satisfied for every ink discharge timing. Here, "$D_M$" represents a delay time for a certain ink discharge timing (a later ink discharge timing), and "$D_{M-1}$" represents a delay time for an earlier ink discharge timing just before the later ink discharge timing.

In S201, while the carriage 11 is moving, the control device 50 detects, by the head position detecting unit 56, a position in the scanning direction of the inkjet head 12 reciprocating together with the carriage 11 along the scanning direction. In S202, the control device 50 calculates the delay time for each individual portion of the recording sheet P. Specifically, while the carriage 11 is moving, the control device 50 sequentially calculates the delay time D based on the position of the inkjet head 12 detected in S201 (the position corresponding to the X coordinate for the interpolation functions E(X) and E'(X)) and one of the interpolation functions E(X) and E'(X) corresponding to the detected position.

In S203, the control device 50 controls the inkjet head 12 to discharge an ink droplet at an ink discharge timing (moment) delayed by the delay time determined in S202. Then, the control device 50 repeatedly performs the steps S201 to S203 until the printing operation is completed (S204: No), and terminates the present process when the printing operation is completed (S204: Yes). At this time, the relational expression "$A+(D_M-D_{M-1})-T>0$" is satisfied for every ink discharge timing. Thus, as described above, it is possible to perform a normal ink discharging operation to sequentially discharge ink droplets from the nozzle 10.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Onlyan exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, by replacing a provisional delay time RM for an ink discharge timing for which the relational expression "$A+(R_M-R_{M-1})-T\leq 0$" holds with a predetermined replacement delay time KM, the interpolation function E(X) is corrected. However, in this respect, a different correction method may be applied.

085In a first modification according to aspects of the present invention, as shown in FIG. 12, auxiliary ribs 71 having the same height lower than the height of the ribs 16 are formed at the right side of the leftmost rib 16, at both the left and right sides of each of the second, fourth, fifth, and seventh ribs from the left end in the scanning direction, and at the left side of the rightmost rib 16. One of two auxiliary ribs 71 disposed to face each other across a corresponding rib 16 in the scanning direction, the one auxiliary rib 71 which is closer to an outer one of two corrugated plates 15 disposed to face each other across the ribs 71 and 16 in the scanning direction than the other auxiliary rib 71, is disposed a longer distance away from the corresponding rib 16 in the scanning direction. Namely, in FIG. 12, a distance I1 is longer than a distance I2, the distance I2 is longer than a distance I3, and the distance I3 is longer than a distance I4 (I1 >I2>I3 >I4).

In this case, in order to hold the recording sheet P in the wave shape, the recording sheet P in a state not held in the wave shape is required to be pulled from the both sides in the scanning direction and pressed down. At this time, it is harder to press down a central portion of the recording sheet P in the scanning direction that is far away from each end of the recording sheet P in the scanning direction. Therefore, without any countermeasure against the problem, the central portion of the recording sheet P might be deformed in the normal wave shape.

In the first modification, as described above, one of two auxiliary ribs 71 disposed to face each other across a corresponding rib 16 in the scanning direction, the one auxiliary rib 71 which is closer to an outer one of two corrugated plates 15 disposed to face each other across the ribs 71 and 16 in the scanning direction than the other auxiliary rib 71, is disposed a longer distance away from the corresponding rib 16 in the scanning direction. Hence, it is harder to press down a portion of the recording sheet P that is farther from the central portion of the recording sheet P in the scanning direction. Thereby, it is possible to press down the recording sheet P with uniform easiness over the whole sheet length in the scanning direction and to certainly deform the recording sheet P in the wave shape.

However, in this case, one of two auxiliary ribs 71 disposed to face each other across a corresponding rib 16 in the scanning direction, the one auxiliary rib 71 which is closer to an outer one of two corrugated plates 15 disposed to face each other across the ribs 71 and 16 in the scanning direction than the other auxiliary rib 71, supports the recording sheet P from underneath in a position closer to its nearest corrugated plate 15. Hence, an outer portion of the recording sheet P is harder to bend downward than an inner portion thereof. Therefore, in such an outer portion of the recording sheet P, the heights of bottom portions Pb are less stable than the heights of top portions Pt.

Thus, in the first modification, with respect to the provisional delay time determined based on the interpolation function E(X), for instance, when the relational expression "$A+(R_M-R_{M-1})-T\leq 0$" holds for an ink discharge timing (moment) corresponding to a segment $S_{N-1}$, as indicated by a thick solid line in FIG. 13A, an interpolation function $E_{N-1}(X)$ for the segment $S_{N-1}$ is corrected to a corrected interpolation function $E'_{N-1}(X)$. Specifically, the interpolation function $E_{N-1}(X)$ for the segment $S_{N-1}$ is heightened as a whole at a predetermined rate so as to be rendered closer to a provisional delay time (a local maximum value of the provisional delay time) for an ink discharge timing (moment) to discharge an ink droplet onto a top portion Pt of $X=X_{N-1}$. Thereby, there is caused a difference in values at $X=X_N$ between the interpolation functions $E'_{N-1}(X)$ and $E_N(X)$. In order to eliminate the difference and provide a smooth transition of the delay time at the boundary between the interpolation functions $E'_{N-1}(X)$ and $E_N(X)$, the interpolation function $E_N(X)$ for the segment $S_N$ is corrected to an interpolation function $E'_N(X)$. Specifically, the interpolation function $E_N(X)$ for the segment $S_N$ is heightened as a whole at a predetermined rate so as to be rendered closer to a provisional delay time (a local maximum value of the provisional delay time) for an ink discharge timing (moment) to discharge an ink droplet onto a top portion Pt of $X=X_{N+1}$.

Thereby, the provisional delay time for the segment $S_{N-1}$ is corrected in such a manner that a variation range thereof is reduced as a whole. Thus, it is possible to reduce the absolute value of the difference "$D_M-D_{M-1}$" in the delay time for each ink discharge timing (moment), and to prevent the difference "$D_M-D_{M-1}$" from being a negative with a large absolute value.

It is noted that "$A+(R_M-R_{M-1})-T$" has the smallest value when $X=(X_{N-1}+X_N)/2$. Further, the predetermined rate is such a rate that the relational expression "$A+(D_M-D_{M-1})-T>0$" holds with respect to a delay time for an ink discharge timing (moment) to discharge an ink droplet onto the position $X=(X_{N-1}+X_N)/2$. Accordingly, it is possible to correct the provisional delay time in such a manner that the relational expression "$A+(D_M-D_{M-1})-T>0$" is satisfied for every ink discharge moment.

In the first modification, as the heights of the top portions Pt are more stable than the heights of the bottom portions Pb, the provisional delay time (in the segment $S_{N-1}$) is lengthened as a whole to be closer to a provisional delay time for an ink discharge timing (moment) to discharge an ink droplet onto the top portion Pt.

However, for instance, when the heights of the bottom portion Pb are as stable as the heights of the top portions Pt, as shown in FIG. 13B, the provisional delay time (in the segment $S_{N-1}$) may be shortened to be closer to a provisional delay time for an ink discharge timing (moment) to discharge an ink droplet onto a bottom portion Pb. In this respect, an interpolation function $E_{N-2}(X)$ may be corrected, instead of $E_N(X)$.

Alternatively, as shown in FIG. 13C, the provisional delay time (in the segment $S_{N-1}$) may be corrected in the following manner. That is, the provisional delay time corresponding to the top portion Pt may be shortened, and the provisional delay time corresponding to the bottom portion Pb may be lengthened, such that the provisional delay times are rendered closer to a provisional delay time for an ink discharge timing (moment) to discharge an ink droplet onto a position where the gap between the ink discharge surface 12*a* and the recording sheet P is an average gap. In this case, both the interpolation function $E_N(X)$ and the interpolation function $E_{N-2}(X)$ may be corrected.

In these cases, the provisional delay time for an ink discharge timing (moment) to discharge an ink droplet onto a position in the segment $S_{N-1}$ is corrected in such a manner that the variation range thereof is reduced as a whole. Thus, it is possible to reduce the absolute value of the difference "$D_M-D_{M-1}$" in the delay time for each ink discharge timing (moment).

In the aforementioned embodiment, the interpolation function E(X) is transformed depending on the position on the recording sheet P in the sheet feeding direction, in such a manner that the base delay time becomes substantially half as long as the upper limit delay time $R_{MAX}$ (the design-based upper limit value of the delay time). However, the base delay time may be the fixed value $R_0$.

The method for correcting the interpolation function E(X) is not limited to the aforementioned methods. The interpolation function E(X) may be corrected in such a different method that a relational expression "$A+(D_M-D_{M-1})-T>0$" is satisfied for every ink discharge moment.

In the aforementioned embodiment, the ink discharge timing is adjusted to be delayed with respect to the reference discharge timing. However, unlike the aforementioned embodiment in which the ink discharge timing is determined based on the detection result of the encoder sensor 20, all the ink discharge timings (moments) may previously be determined before execution of the printing operation. In this modification, each ink discharge timing (moment) may be adjusted to be earlier than the reference discharge timing. In this case, the aforementioned times DM, DM-1, RM, and RM-1, when being rendered earlier than the reference discharge timings, may be negative values (the aforementioned times DM, DM-1, RM, and RM-1, when being rendered later than the reference discharge timings, are positive values).

In the aforementioned embodiment, an ink discharge timing is determined by determining how long the ink discharge timing is to be delayed. However, the ink discharge timing may directly be determined. Even in this case, it is possible to perform a normal ink discharging operation by determining the ink discharge timing in such a manner that a time interval between successive two ink discharge timings in the case where the inkjet head 12 continuously discharges ink droplets from the nozzles 10 is longer than the predetermined time required for the operation to be executed by the inkjet head 12 when discharging an ink droplet from a nozzle 10 and forming a single dot.

In the aforementioned embodiment, the delay time is determined based on the intersection deviation value acquired by reading the deviation detecting pattern Q. However, the delay time may be determined based on different information such as the positional deviation value of the ink landing position in the scanning direction and the gap between the ink discharge surface 12*a* and the recording sheet P.

In the aforementioned embodiment, the interpolation function E'(X) for the delay time is determined by determining the interpolation function E(X) for the provisional delay time when the recording sheet P is held in the predetermined wave shape and correcting the interpolation function E(X) when there is an ink discharge timing for which the relational expression "$A+(R_M-R_{M-1})-T\leq 0$" holds. However, an interpolation function determined in the same manner as when the interpolation function E(X) is determined may be a final interpolation function for the intended delay time. In this case, the heights of the corrugated plates 15, the ribs 16, and the corrugated spur wheels 18 and 19 may be adjusted in such a manner that the relational expression "$A+(R_M-R_{M-1})-T>0$" is satisfied for every ink discharge timing determined based on the final interpolation function.

What is claimed is:

1. An inkjet printer comprising:

an inkjet head configured to discharge ink droplets from nozzles formed in an ink discharge surface thereof;

a head moving unit configured to reciprocate the inkjet head relative to a recording sheet along a scanning direction parallel to the ink discharge surface;

a wave shape generating mechanism configured to deform and hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction;

a gap variation storing unit configured to store gap variation information related to a variation, in the scanning direction, of a gap between the ink discharge surface and the recording sheet held in the wave shape; and a control device configured to determine, based on the gap variation information, ink discharge moments to sequentially discharge ink droplets from a specific one of the nozzles, in such a manner that a time interval between any two successive ones of the ink discharge moments is longer than a predetermined time period for an operation to be executed by the inkjet head when forming a single dot;

wherein the control device is further configured to determine the ink discharge moments by determining an adjustment time as a time difference between each individual ink discharge moment and a reference discharge moment previously determined for each individual ink discharge moment, in such a manner that a relational expression "$A+(D_M-D_{M-1})-T>0$" is satisfied for every ink discharge moment, where the adjustment time for each individual ink discharge moment is a positive value when each individual ink discharge moment is later than the reference discharge moment therefor, "$D_M$" represents an adjustment time for a later ink discharge moment, "$D_{M-1}$" represents an adjustment time for an earlier ink discharge moment just before the later ink discharge moment, "A" represents a reference time interval between two successive reference discharge moments, and "T" represents the predetermined time period required for the operation to be executed by the inkjet head when forming a single dot.

2. The inkjet printer according to claim 1, wherein the control device is further configured to:

determine a provisional adjustment time that is a provisional value of the adjustment time for each individual ink discharge moment;

determine whether a relational expression "$A+(R_M-R_{M-1})-T>0$" is satisfied for each individual ink discharge moment, where "$R_M$" represents a provisional adjustment time for a later ink discharge moment, and "$R_{M-1}$" represents a provisional adjustment time for an earlier ink discharge moment just before the later ink discharge moment;

when determining that the relational expression "$A+(R_M-R_{M-1})-T>0$" is satisfied for a first ink discharge moment, determine a provisional adjustment time for the first ink discharge moment as an adjustment time for the first ink discharge moment; and when determining that the relational expression "$A+(R_M-R_{M-1})-T>0$" is not satisfied for a second ink discharge moment, correct a provisional adjustment time for the second ink discharge moment, and determine the corrected provisional adjustment time as an adjustment time for the second ink discharge moment.

3. The inkjet printer according to claim 2, wherein the control device is further configured to:

determine a provisional delay time period as the provisional adjustment time for each individual ink discharge moment, the provisional delay time period being a time difference between each individual ink discharge moment and the reference discharge moment previously determined as a moment earlier than each individual ink discharge moment;

determine whether the relational expression "$A+(R_M-R_{M-1})-T>0$" is satisfied for each individual ink discharge moment, where "$R_M$" represents a provisional delay time period for a later ink discharge moment, and "$R_{M-1}$" represents a provisional delay time period for an earlier ink discharge moment just before the later ink discharge moment; and when determining that the relational expression "$A+(R_M-R_{M-1})-T>0$" is not satisfied for a specific ink discharge moment, correct a provisional delay time period for the specific ink discharge moment by replacing the provisional delay time period for the specific ink discharge moment with a replacement delay time period "$K_M$" that satisfies a relational expression "$A+(K_M-R_{M-1})-T=B$," where "B" is a positive constant value determined so as to satisfy, for every ink discharge moment, a requirement that an absolute value of a difference between a delay time period for a later ink discharge moment and a delay time period for an earlier ink discharge moment just before the later ink discharge moment is equal to or less than a predetermined upper limit.

4. The inkjet printer according to claim 3, wherein the control device is further configured to:

determine the provisional delay time period for each individual ink discharge moment so as to set a base delay time period to be half as long as a predetermined upper limit delay time period, the base delay time period being a provisional delay time period when the gap between the ink discharge surface and the recording sheet is equal to an average value thereof in the scanning direction; and determine, based on the determined provisional delay time period, a delay time period for each individual ink discharge moment to be equal to or shorter than the predetermined upper limit delay time period.

5. The inkjet printer according to claim 4, wherein the control device is further configured to determine the provisional delay time period for each individual ink discharge moment based on the base delay time period changed depending on a position on the recording sheet in a direction perpendicular to the scanning direction.

6. The inkjet printer according to claim 2, wherein the control device is further configured to:

determine a provisional delay time period as the provisional adjustment time for each individual ink discharge moment, the provisional delay time period being a time difference between each individual ink discharge moment and the reference discharge moment previously determined as a moment earlier than each individual ink discharge moment;

determine whether the relational expression "$A+(R_M-R_{M-1})-T>0$" is satisfied for each individual ink discharge moment, where "$R_M$" represents a provisional delay time period for a later ink discharge moment, and "$R_{M-1}$" represents a provisional delay time period for an earlier ink discharge moment just before the later ink discharge moment; and when determining that the relational expression "$A+(R_M-R_{M-1})-T>0$" is not satisfied for a specific ink discharge moment to discharge an ink droplet into a specific position in the scanning direction on the recording sheet held in the wave shape, correct provisional delay time periods for ink discharge moments to discharge ink droplets into a specific segment, including the specific position, of a plurality of segments each defined between two adjacent portions of the top portions and the bottom portions alternately arranged along the scanning direction, so as to reduce as a whole a variation range of the provisional delay time periods for the specific segment, and determine the corrected provisional delay time periods as delay time periods for the ink discharge moments to discharge ink droplets into the specific segment, so as to satisfy, for every ink discharge moment to discharge an ink droplet into the specific segment, a requirement that an absolute value of a difference between a delay time period for a later ink discharge moment and a delay time period for an earlier ink discharge moment just before the later ink discharge moment is equal to or less than a predetermined upper limit.

7. The inkjet printer according to claim 6, wherein the wave shape generating mechanism comprises:

a plurality of supporting portions that are arranged at intervals along the scanning direction and configured to support the recording sheet from a side opposite to a side facing the ink discharge surface; and a plurality of pressing portions each disposed between two adjacent ones of the plurality of supporting portions in the scanning direction and configured to press a part of the recording sheet between the two adjacent supporting portions in the second direction, and wherein the control device is further configured to correct the provisional delay time periods for the ink discharge moments to discharge ink droplets into the specific segment to be rendered, at a predetermined rate as a whole, closer to a provisional delay time period for an ink discharge moment to discharge an ink droplet onto a top portion located at one end of the specific segment in the scanning direction, the predetermined rate determined to satisfy the relational expression "$A+(D_M-D_{M-1})-T>0$" for every ink discharge moment to discharge an ink droplet into the specific segment.

8. The inkjet printer according to claim 6, wherein the control device is further configured to:

when correcting a provisional delay time period for an ink discharge moment to discharge an ink droplet onto the top portion located at the one end of the specific segment in the scanning direction, correct the provisional delay time periods for the ink discharge moments to discharge ink droplets into the specific segment and provisional delay time periods for ink discharge moments to discharge ink droplets into a segment adjacent to the one end of the specific segment in the scanning direction, so as to reduce as a whole a variation range of the provisional delay time periods for the specific segment and the segment adjacent to the one end of the specific segment in the scanning direction; and when correcting a provisional delay time period for an ink discharge moment to discharge an ink droplet onto a bottom portion located at a different end of the specific segment in the scanning direction, correct the provisional delay time periods for the ink discharge moments to discharge ink droplets into the specific segment and provisional delay time periods for ink discharge moments to discharge ink droplets into a segment adjacent to the different end of the specific segment in the scanning direction, so as to reduce as a whole a variation range of the provisional delay time periods for the specific segment and the segment adjacent to the different end of the specific segment in the scanning direction.

9. The inkjet printer according to claim 6, wherein the control device is further configured to:

determine the provisional delay time period for each individual ink discharge moment so as to set a base delay time period to be half as long as a predetermined upper limit delay time period, the base delay time period being a provisional delay time period when the gap between the ink discharge surface and the recording sheet is equal to an average value thereof in the scanning direction; and determine, based on the determined provisional delay time period, a delay time period for each individual ink discharge moment to be equal to or shorter than the predetermined upper limit delay time period.

10. The inkjet printer according to claim 9, wherein the control device is further configured to determine the provisional delay time period for each individual ink discharge moment based on the base delay time period changed depending on a position on the recording sheet in a direction perpendicular to the scanning direction.

11. The inkjet printer according to claim 1, wherein the wave shape generating mechanism is configured to deform and hold the recording sheet in the predetermined wave shape that satisfies for every ink discharge moment the relational expression "$A+(D_M-D_{M-1})-T>0$" for every ink discharge moment.

* * * * *